US005169457A

United States Patent [19]

Nishimoto et al.

[11] Patent Number: 5,169,457

[45] Date of Patent: Dec. 8, 1992

[54] METHOD OF MAKING NON-ORIENTED ELECTRICAL STEEL SHEETS

[75] Inventors: Akihiko Nishimoto; Yoshihiro Hosoya; Kunikazu Tomita; Toshiaki Urabe; Masaharu Jitsukawa, all of Tokyo, Japan

[73] Assignee: NKK Corporation, Tokyo, Japan

[21] Appl. No.: 432,740

[22] PCT Filed: Mar. 7, 1989

[86] PCT No.: PCT/JP89/00241

§ 371 Date: Oct. 17, 1989

§ 102(e) Date: Oct. 17, 1989

[87] PCT Pub. No.: WO89/08720

PCT Pub. Date: Sep. 21, 1989

[51] Int. Cl.[5] ..... H01F 1/04

[52] U.S. Cl. ..... 148/111; 148/112

[58] Field of Search ..... 148/111, 112

[56] References Cited

FOREIGN PATENT DOCUMENTS 57-57829 4/1982 Japan ..... 148/111

58-151453 9/1983 Japan .

58-171527 10/1983 Japan .

0198427 8/1989 Japan ..... 148/111

0121125 9/1989 Japan ..... 148/111

*Primary Examiner*—John P. Sheehan

*Attorney, Agent, or Firm*—Nields & Lemack

[57] ABSTRACT

A steel slab containing not more than 0.005 wt% carbon, 1.0 to 4.0 wt% silicon, 0.1 to 1.0 wt% manganese, not more than 0.1 wt% phosphorus, not more than 0.005 wt% sulfur, and 0.1 to 2.0 wt% aluminum is directly sent to a hot rolling step without brief soaking, whereby Al and N are made soluble with respect to species other than AlN inevitably precipitated during hot rolling, and uniform and coarse AlN precipitation is formed by a subsequent annealing treatment in which the hot rolled plate is soaked at a temperature of 800° to 1000° C. for a period of time t defined as exp $(-0.018T+19.4) \leqq t \leqq \exp(-0.022T+25.4)$ wherein T is the soaking temperature (°C.) and t is the soaking time (minutes). Uniform and satisfactory ferrite grain growth at the recrystallization annealing is provided thereby.

1 Claim, 2 Drawing Sheets

METHOD OF MAKING NON-ORIENTED ELECTRICAL STEEL SHEETS

TECHNICAL FIELD

This invention relates to a method of making non-oriented electrical steel sheets.

BACKGROUND OF THE INVENTION

Important factors in governing magnetic properties of electrical steel sheets include sizes and dispersing conditions of Aln and MnS precipitates in steels. These precipitates are obstacles to movements of magnetic domain walls and deteriorate not only the magnetic flux density under a low magnetic field but also the iron loss. In addition, they hinder gain growth during recrystallization annealing, and immature gain growth of ferrite grains negatively influence developments of recrystallization texture preferable to the magnetic properties.

It is known that rougher and coarser precipitates are preferable for the movements of the magnetic domain walls during magnetization. Based on such background, there has been disclosed in the prior art attempts to provide coarser precipitates of AlN or MnS before the recrystallization annealing in the processes of making the electrical steel sheets. For example, Japanese Patent Laid-Open Specification 38814/74 checks disolution of the coarse AlN during slab soaking by lowering the heating temperature thereof; Japanese Patent Laid-Open Specification 22,931/81 lowers the amounts of S and O accompanying growthes of fine non-metallic inclusions; Japanese Patent Laid-Open Specification 8,409/80 controls formation of sulphides by addition of Ca or REM; Japanese Patent Laid-Open Specifications 108,318/77, 41,219/79 and 123,825/83 coarsen AlN by brief soaking of the slab before the hot rolling; and Japanese Patent Laid-Open Specification 76,422/79 utilizes a self-annealing effect by coiling at super high temperature after hot rolling for coarsening AlN and accelerating growth of ferrite grain.

From a viewpoint of saving energy in the process, it is advantageous to carry out a hot direct rolling from the continuous casting of a slab when performing the hot rolling. However, if this process is used, a problem occurs that the coarse precipitations of AlN and MnS are made insufficient. To solve this problem, the slab is subjected to the brief soaking before the hot rolling.

However, although the soaking time is short, such a process which once transfers the slab into the heating and soaking furnaces, could not enjoy the merits of saving energy brought about by the hot direct rolling. Furthermore, for providing precipitation of AlN, if the soaking time is short, the precipitation will be non-uniform at the inside and outside of the slab.

DISCLOSURE OF THE INVENTION

In view of these problems of the prior art, in the invention the slab is directly sent to the hot rolling without the brief soaking, whereby Al and N are maintained in solution with respect to species other than AlN inevitably precipitated during hot rolling, and uniform and coarse AlN precipitation is formed by a subsequent annealing treatment. Uniform and satisfactory ferrite grain growth at the recrystallization annealing is thereby provided.

That is, the invention comprises hot rolling a slab immediately after continuously casting thereof without brief soaking at a specified temperature range, said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %; coiling at a temperature of not more than 650° C.; annealing the hot rolled plate by soaking it at the temperature of 800° to 1000° C. for a period of time satisfying $$\exp(-0.018T+19.4) \leqq t \leqq \exp(-0.022T+25.4)$$

herein,

T: soaking temperature (°C.)

t: soaking time (min);

subjecting the thus annealed plate to enter a one-time cold rolling or to more than one cold rollings having interposed therebetween intermediate annealings; and a final continuous annealing at a temperature range between 850° and 1100° C.

DETAILED DESCRIPTION OF THE INVENTION

In the invention, the hot rolling is performed on the slab immediately after continuously casting thereof without brief soaking at a specified temperature range ("Hot Direct Rolling"), said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %, and the coiling is operated at a temperature of not more than 650° C.

The present invention is based on a premise of hot direct rolling, and optimizes sizes and dispersing conditions of AlN and MnS which create problems in the magnetic property. Negative influences of MnS can be avoided by controlling the steel composition, but with respect to AlN, a measure is indispensable in the process. The precipitating nose of AlN is 800° to 1000° C. For precipitating AlN when the steel material is a slab, it is necessary to carry out a recrystallization annealing after precipitation for securing a rolling temperature. However, the heating and the heat-maintaining steps at the slab age spoil the energy-savings characteristics of the hot direct rolling. Therefore, in the invention, AlN is precipitated in a heating treatment after the hot rolling, the brief soaking is not carried out when the steel is a slab, and the coiling is operated at a temperature of not lower than 650° C. after the hot rolling, whereby the entire amount other than the AlN (which is inevitably precipitated) is in the solid-solution state.

The hot rolled band is sent to a subsequent annealing furnace. The annealing is, in the invention, performed at a temperature between 800° and 1000° C., which approximates the precipitating nose of AlN for providing perfect precipitation of Al and N as AlN, coarsening thereof and recrystallization of ferrite grain and grain growth thereof.

If the annealing temperature is lower than 800° C., coarsening of AlN is not satisfactory, and if it is higher than 1000° C., the ferrite grain grow extraordinarily, and ridge like defects appear on the steel surface under the cold rolling and recrystallization annealing.

Figure 1:
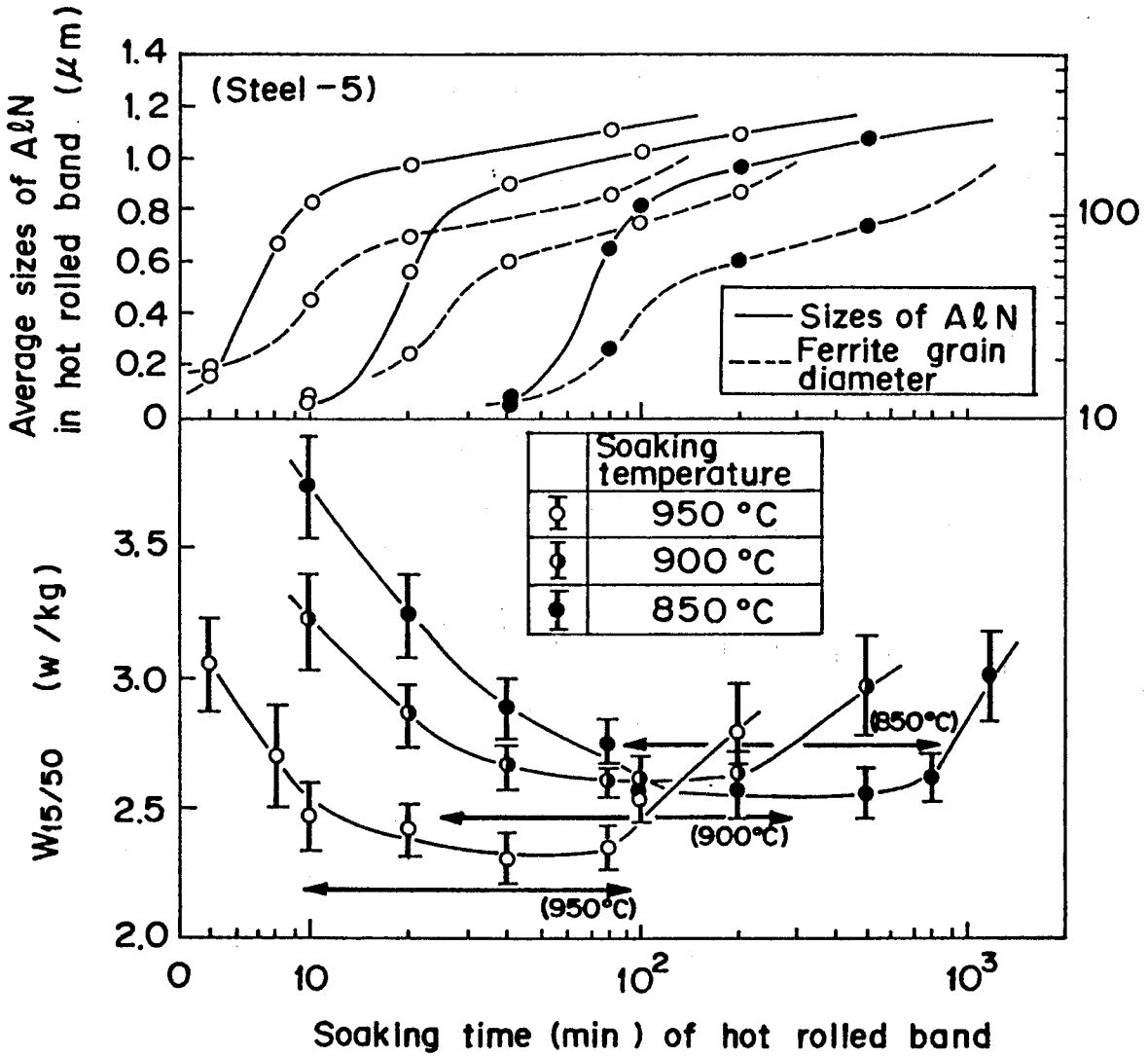
FIG. 1 shows, with respect to 3% Si steel, influences of the soaking time of the hot rolled band on the average size of AlN during hot rolling and on the magnetic properties.
Figure 2:
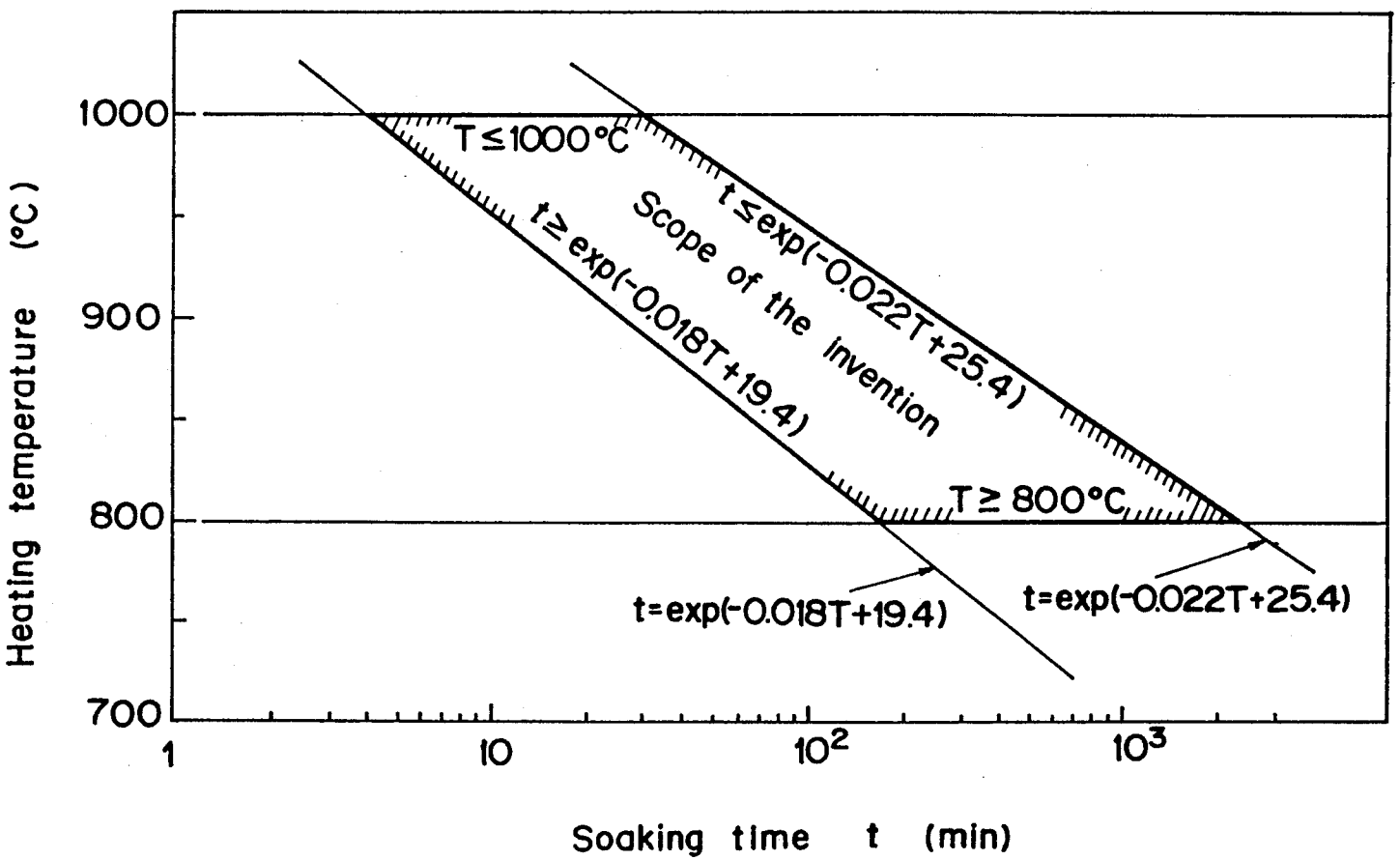
FIG. 2 shows optimum ranges of the soaking temperature and the soaking time during annealing of the hot band.

The soaking time t in the annealing furnace is defined in a determined range in relation to the above stated soaking temperature T. FIG. 1 shows, with respect to 3% Si steel (Steel 5 of Table 1), influences of the soaking time of the hot rolled band to average size of AlN during hot rolling and to magnetic properties after the final annealing, and it is seen the best range exists in the annealing time of the hot rolled band in response to the soaking temperature. As a result of experiments including also the above case it is seen that the soaking t (min) should satisfy the following condition in relation to the soaking temperature T (°C.):

$$\exp(-0.018T+19.4) \leqq t \leqq \exp(-0.022T+25.4).$$

That is, for full coarsening of Aln at which the present invention aims, $t \geqq \exp(-0.018T+19.4)$ must be satisfied. If the socking is carried out longer than necessary, the ferrite grains grown abnormally at temperatures higher than 900° C., and the magnetic properties are deteriorated by formation of a nitride layer at temperatures below 900° C. If the soaking time t (min) exceeds $\exp(-0.022T+25.4)$, the above mentioned problems also occur. Against nitrization, it is useful to preliminary remove scales by pickling, but as a practical allowance, the above limit is specified.

The steel sheet, having passed the hot rolling procedure and the annealing process, is subjected to one cold rolling or plural cold rollings interposing therebetween an intermediate annealing, and to the final finish annealing within the temperature range between 850° and 1100° C.

If the soaking temperature of the final annealing is less than 850° C., desired excellent iron loss and the magnetic flux density could not be obtained. If the soaking temperature exceeds 1100° C., such temperatures are not practical in terms of passing of the coil and energy costs. In addition, in terms of the magnetic properties, the iron loss value increases reversely by the abnormal grain growth of ferrite.

Reference now will be made to reasons for limiting the steel composition.

The amount of carbon is set at not more than 0.005 wt % when producing a steel slab, so as to secure the ferrite grain growth by lowering C during heat treatment of the hot rolled band and affect coarsening of AlN via decreasing the solubility limit of AlN accompanied with stabilization of ferrite phases.

Silicon content of less than 1.0 wt % cannot satisfy the lower iron loss due to lowering of the proper electrical resistivity. On the other hand, if it exceeds 4.0 wt %, the cold rolling becomes difficult due to shortening of the ductility of the steel.

The upper limit of sulfur is specified for improving the magnetic properties by decreasing an absolute amount of MnS. If S is set below 0.005 wt %, the level is negligible in terms of the negative influences of MnS in the direct hot rolling.

An aluminum content of less than 0.1 wt % cannot fully coarsen AlN nor avoid fine precipitation of AlN. If it exceeds 2.0 wt %, effects of the magnetic properties are not brought about, and a problem arises regarding weldability and brittleness.

Based upon the present invention, it is possible to satisfactorily secure precipitation and coarsening of AlN and ferrite grain growth in the hot rolling process, while performing the hot direct rolling. Therefore, it is possible to produce economically non-oriented electrical steel sheet with excellent magnetic properties, by fully making use of the merits of the direct hot rolling.

EXAMPLE

The continuously cast slabs having the chemical compositions of Table 1 were passed through Hot Rolling—Annealing—Pickling—Cold Rolling—Final Continuous Annealing, and the non-oriented electrical steel sheets were produced. The magnetic properties of the produced electrical steel sheets and the characteristics of the hot rolled bands are shown in Table 2 together with the conditions of the hot rolling, annealing and final annealing.

TABLE 1

| | (wt %) | | | | | | |
|---|---|---|---|---|---|---|---|
| No. | C | Si | Mn | P | S | Sol. Al | N |
| 1 | 0.0027 | 1.70 | 0.23 | 0.010 | 0.003 | 0.25 | 0.0015 |
| 2* | 0.0029 | 1.72 | 0.25 | 0.012 | 0.002 | 0.05 | 0.0017 |
| 3* | 0.0031 | 1.71 | 0.20 | 0.008 | 0.008 | 0.31 | 0.0017 |
| 4 | 0.0025 | 2.24 | 0.19 | 0.009 | 0.003 | 0.29 | 0.0014 |
| 5 | 0.0024 | 3.05 | 0.30 | 0.011 | 0.003 | 0.32 | 0.0013 |
| 6* | 0.0032 | 3.15 | 0.28 | 0.010 | 0.010 | 0.34 | 0.0014 |

Note
*Comparative Steels

TABLE 2

| | | B | C | | F | | I | J | K | |
|---|---|---|---|---|---|---|---|---|---|---|
| No. | A | (°C.) | D (°C.) | E (min) | G (μm) | H (μm) | (°C.) | (μm) | $B_3$ (T) | $W_{15/50}$ (w/Kg) |
| 1 | Com. P. | 590 | 950 | 5 | 0.15 | 5 | 850 | 75 | 1.25 | 4.25 |
| | Inv. P. | 590 | 950 | 20 | 0.84 | 11 | 850 | 110 | 1.45 | 3.44 |
| | Com. P. | 600 | 850 | 20 | 0.12 | 4 | 850 | 70 | 1.31 | 4.53 |
| | Inv. P. | 600 | 850 | 180 | 0.95 | 8 | 850 | 115 | 1.44 | 3.32 |
| | Com. P. | 600 | 850 | 1200 | 1.05 | 45 | 850 | 145 | 1.42 | 4.15 |
| | " | 600 | 750 | 1200 | 0.42 | 30 | 850 | 87 | 1.32 | 4.43 |
| | " | 750 | 850 | 180 | 1.26 | 125 | 850 | 130 | 1.21 | 4.98 |
| 5 | Com. P. | 620 | 950 | 5 | 0.21 | 4 | 950 | 89 | 1.31 | 3.70 |
| | Inv. P. | 620 | 950 | 20 | 0.98 | 6 | 950 | 135 | 1.47 | 2.61 |
| | Com. P. | 620 | 950 | 100 | 1.23 | 30 | 950 | 140 | 1.25 | 3.22 |
| | Inv. P. | 620 | 850 | 180 | 1.08 | 3 | 950 | 138 | 1.48 | 2.43 |
| | Com. P. | 780 | 850 | 180 | 1.35 | 165 | 950 | 150 | 1.30 | 3.84 |
| 2 | Inv. P. | 600 | 850 | 180 | 0.34 | 2 | 850 | 74 | 1.29 | 4.72 |
| 3 | " | 600 | 850 | 180 | 1.01 | 3 | 850 | 70 | 1.32 | 4.48 |
| 4 | " | 600 | 850 | 180 | 1.12 | 3 | 900 | 124 | 1.44 | 3.02 |

TABLE 2-continued

| No. | A | B (°C.) | C D (°C.) | C E (min) | F G (μm) | F H (μm) | I (°C.) | J (μm) | K $B_3$ (T) | K $W_{15/50}$ (w/Kg) |
|---|---|---|---|---|---|---|---|---|---|---|
| 6 | " | 620 | 850 | 180 | 0.40 | 4 | 950 | 83 | 1.30 | 3.85 |

Note
Com. P.: Comparison Process
Inv. P.: Invention Process
A: Manufacturing processes
B: Coiling temperature of hot rolled band
C: Heat treating conditions of hot rolled band
D: Heating temperature
E: Soaking time
F: Micro-substructure of hot rolled band
G: AlN size
H: Nitride layer
I: Annealing temperature
J: Grain diameter after annealing
K: Magnetic properties
*: Comparative steels

INDUSTRIAL APPLICABILITY

The present invention may be applied to production of non-oriented electrical steel sheets.

We claim:

1. A method of making non-oriented electrical steel sheets having excellent magnetic properties, comprising hot rolling a slab immediately after continuously casting thereof without maintaining the heat at any specified temperature range and without heating at any specified temperature range, said slab containing C: not more than 0.005 wt %, Si: 1.0 to 4.0 wt %, Mn: 0.1 to 1.0 wt %, P: not more than 0.1 wt %, S: not more than 0.005 wt %, Al: 0.1 to 2.0 wt %; thereafter coiling at temperature of not more than 650° C.; annealing the hot rolled plate by soaking it at the temperature of 800° to 1000° C. for a period of time satisfying $$\exp(-0.018T+19.4) \leqq t \leqq \exp(-0.022T+25.4)$$

herein,

T: soaking temperature (°C.)

t: soaking time (min);

subjecting the thus-annealed plate either to a one-time cold rolling or to plural cold-rollings having interposed therebetween intermediate annealings; and thereafter subjecting the thus cold-rolled plate to a final continuous annealing at range of temperature between 850° and 1100° C.

* * * * *